US007104255B2

(12) United States Patent
Hashima et al.

(10) Patent No.: US 7,104,255 B2
(45) Date of Patent: Sep. 12, 2006

(54) METHOD AND APPARATUS FOR CONTROLLING OPERATION OF INTERNAL COMBUSTION ENGINE, AND THE INTERNAL COMBUSTION ENGINE

(75) Inventors: Takashi Hashima, Gotenba (JP); Terutoshi Tomoda, Mishima (JP); Kichiro Kato, Nagaizumi-cho (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/048,745

(22) Filed: Feb. 3, 2005

(65) Prior Publication Data

US 2005/0199218 A1 Sep. 15, 2005

(30) Foreign Application Priority Data

Mar. 10, 2004 (JP) ..... 2004-067541

(51) Int. Cl.

| | |
|---|---|
| ***F02B 7/04*** | (2006.01) |
| ***F02B 15/02*** | (2006.01) |
| *F02B 5/00* | (2006.01) |
| *F02B 17/00* | (2006.01) |

(52) U.S. Cl. ..... 123/431; 123/305

(58) Field of Classification Search ..... 123/296, 123/295, 298, 299, 300, 305, 431, 478, 480; 701/103–105

See application file for complete search history.

(56) References Cited

U.S. PATENT DOCUMENTS

| | | | | |
|---|---|---|---|---|
| 4,721,080 | A * | 1/1988 | Moriyasu et al. | 123/276 |
| 5,875,743 | A | 3/1999 | Dickey | 123/25 C |
| 5,924,405 | A * | 7/1999 | Hashimoto | 123/431 |
| 5,970,950 | A | 10/1999 | Shimizu et al. | 123/295 |
| 6,314,940 | B1 | 11/2001 | Frey et al. | 123/431 |
| 6,637,406 | B1 * | 10/2003 | Yamada et al. | 123/431 |
| 6,659,073 | B1 | 12/2003 | Franke et al. | 123/299 |
| 6,725,649 | B1 * | 4/2004 | Yamashita et al. | 123/431 |
| 2005/0072402 | A1 * | 4/2005 | Zurloye et al. | 123/431 |

FOREIGN PATENT DOCUMENTS

| | | |
|---|---|---|
| DE | 100 43 366 A1 | 3/2002 |
| EP | 0 849 459 A1 | 6/1998 |
| EP | 1128 048 A1 | 8/2001 |
| GB | 1 389 383 | 4/1975 |
| GB | 2 301 459 A | 12/1996 |
| JP | A 06-108907 | 4/1994 |
| JP | A 10-169489 | 6/1998 |
| JP | A 2001-20837 | 1/2001 |
| JP | A 2001-020837 | 1/2001 |

* cited by examiner

*Primary Examiner*—Willis R. Wolfe, Jr.
(74) *Attorney, Agent, or Firm*—Oliff & Berridge, PLC

(57) ABSTRACT

In an internal combustion engine, it is first determined whether a load factor of the internal combustion engine is a specified value or more and the engine speed of the internal combustion engine is a specified speed or less. If these conditions are satisfied, fuel is injected from both of a port injection valve and a direct injection valve, and a fuel injection timing of the direct injection valve is decided so as to inject fuel from the direct injection valve during the compression stroke of the internal combustion engine.

10 Claims, 11 Drawing Sheets

METHOD AND APPARATUS FOR CONTROLLING OPERATION OF INTERNAL COMBUSTION ENGINE, AND THE INTERNAL COMBUSTION ENGINE

BACKGROUND OF THE INVENTION

1) Field of the Invention

The present invention relates to controlling an operation of an internal combustion engine that includes a port injection valve and a direct injection valve.

2) Description of the Related Art

In a direct-injection internal combustion engine, fuel is directly injected into the cylinder. The direct-injection internal combustion engine can operate in a stratified combustion and a uniform combustion.

In the stratified combustion, fuel is injected in the cylinder during a compression stroke and a stratification of fuel is formed in the cylinder. Precisely, a mixture of fuel and air that is easy to ignite is accumulated near the spark plug, and the air that is hard to ignite is made to surround the mixture. The stratified combustion can produce ultra lean combustion. In other words, the stratified combustion allows both the reduction in the amount of the fuel and the reduction in the $CO_2$ emission.

On the other hand, in the uniform combustion, fuel is injected in the cylinder during an intake stroke, and the fuel is made to disperse uniformly inside the cylinder. In the uniform combustion, intake air can be cooled by the heat of vaporization of the fuel, which allows better filling efficiency and, therefore, higher output. Therefore, the engine is operated in the uniform combustion if high torque is required.

In the uniform combustion, a large amount of fuel is injected in the cylinder particularly at the time of high output or high load. However, if a large amount of fuel is injected in the cylinder at one time, the fuel does not evaporate effectively. This causes improper combustion and results in a decrease in the torque. Japanese Patent Application Laid-Open Publication No. 2001-20837 discloses a solution to this problem. The engine disclosed in this publication includes a main fuel injection valve that injects fuel directly into a cylinder and an auxiliary fuel injection valve that injects fuel into an intake port. Moreover, how much fuel is to be injected from both the main fuel injection valve and the auxiliary fuel injection valve is controlled based on an operating state of the engine.

When the uniform combustion is employed, the fuel is injected from the direct injection valve during an intake stroke. However, knocking easily occurs if the internal combustion engine is operated at a high load and at low to medium speeds. Therefore, conventionally, torque of the internal combustion engine is sacrificed to suppress the knocking.

SUMMARY OF THE INVENTION

It is an object of the present invention to provide an internal combustion engine that produces higher torque while suppressing occurrence of knocking.

A method according to an aspect of the present invention is a method of controlling an internal combustion engine that includes a port injection valve that injects fuel into an intake passage of the internal combustion engine; and a direct injection valve that injects fuel directly into a combustion chamber of the internal combustion engine. The method includes determining whether, as operating conditions of the internal combustion engine during uniform combustion, a load of the internal combustion engine is equal to a specified value or more, and an engine speed of the internal combustion engine is equal to a specified speed or less; and injecting fuel from both the port injection valve and the direct injection valve if it is determined at the determining that the operating conditions are satisfied, and injecting fuel from the direct injection valve during a compression stroke.

The method further comprising shifting a fuel injection timing of the direct injection valve to a delay angle side based on an ignition top dead center as a reference, as a fuel injection ratio of the direct injection valve decreases.

An apparatus according to another aspect of the present invention is an apparatus for controlling operation of an internal combustion engine, the internal combustion engine including a port injection valve that injects fuel into an intake passage of the internal combustion engine, and a direct injection valve that injects fuel directly into a combustion chamber of the internal combustion engine. The apparatus includes an operating condition determining unit that determining whether, as operating conditions of the internal combustion engine during uniform combustion, a load of the internal combustion engine is equal to a specified value or more, and an engine speed of the internal combustion engine is equal to a specified speed or less; a fuel-injection-timing deciding unit that decides a fuel injection timing of the direct injection valve, if the operating condition determining unit determines that the operating conditions are satisfied, so as to inject fuel from the direct injection valve during a compression stroke of the internal combustion engine; a fuel-injection-ratio deciding unit that decides a fuel injection ratio between the direct injection valve and the port injection valve; and a fuel injection controller that causes both the port injection valve and the direct injection valve to inject fuel at the fuel injection ratio decided by the fuel-injection-ratio deciding unit and at the fuel injection timing of the direct injection valve decided by the fuel-injection-timing deciding unit.

In the above apparatus, the fuel-injection-timing deciding unit shifts the fuel injection timing of the direct injection valve toward a delay angle side based on an ignition top dead center as a reference, as the fuel injection ratio of the direct injection valve decreases.

An internal combustion engine according to still another aspect of the present invention includes a cylinder; a piston that reciprocates in the cylinder; a direct injection valve that injects fuel, at a predetermined ratio of a whole amount of fuel injection, directly into a combustion chamber during a compression stroke when operating conditions are such that uniform combustion is carried out, a load is a specified value or more, and an engine speed is a specified speed or less; and a port injection valve that injects fuel into an intake passage for supplying air into a combustion chamber of the cylinder under the operating conditions, the fuel being an amount corresponding to a remaining ratio, of the whole amount of fuel injection, other than a ratio at which the fuel is injected by the direct injection valve.

In the above internal combustion engine, a fuel injection timing of the direct injection valve is shifted to a delay angle side based on an ignition top dead center as a reference, as the fuel injection ratio of the direct injection valve decreases.

In the above internal combustion engine, the piston has a cavity, and the fuel is injected from the direct injection valve into the cavity.

In the above internal combustion engine, the piston has a plurality of cavities, and the fuel is injected from the direct injection valve into at least one of the cavities.

In the above internal combustion engine, the piston has a cavity, and the fuel is injected from the direct injection valve into the cavity, and the direct injection valve is positioned in such a manner that the fuel is injected in a direction that is inclined to an axis of the piston that is perpendicular to an axis of movement of the piston.

In the above internal combustion engine, the piston has a cavity and a projection in the cavity, the projection points toward the direct injection valve and in a radius direction of the piston, and the fuel is injected from the direct injection valve on the projection.

The other objects, features, and advantages of the present invention are specifically set forth in or will become apparent from the following detailed description of the invention when read in conjunction with the accompanying drawings.

DETAILED DESCRIPTION

Exemplary embodiments of the present invention are explained in detail below with reference to the accompanying drawings. It is noted that the present invention is not limited to these embodiments. Components in the embodiments explained below include those easily thought of by persons skilled in the art or those practically equivalent to the components. The present invention can be suitably used in reciprocating internal combustion engines, and can be particularly suitably used in the internal combustion engines of vehicles such as automobiles, buses, or trucks.

Figure 1:
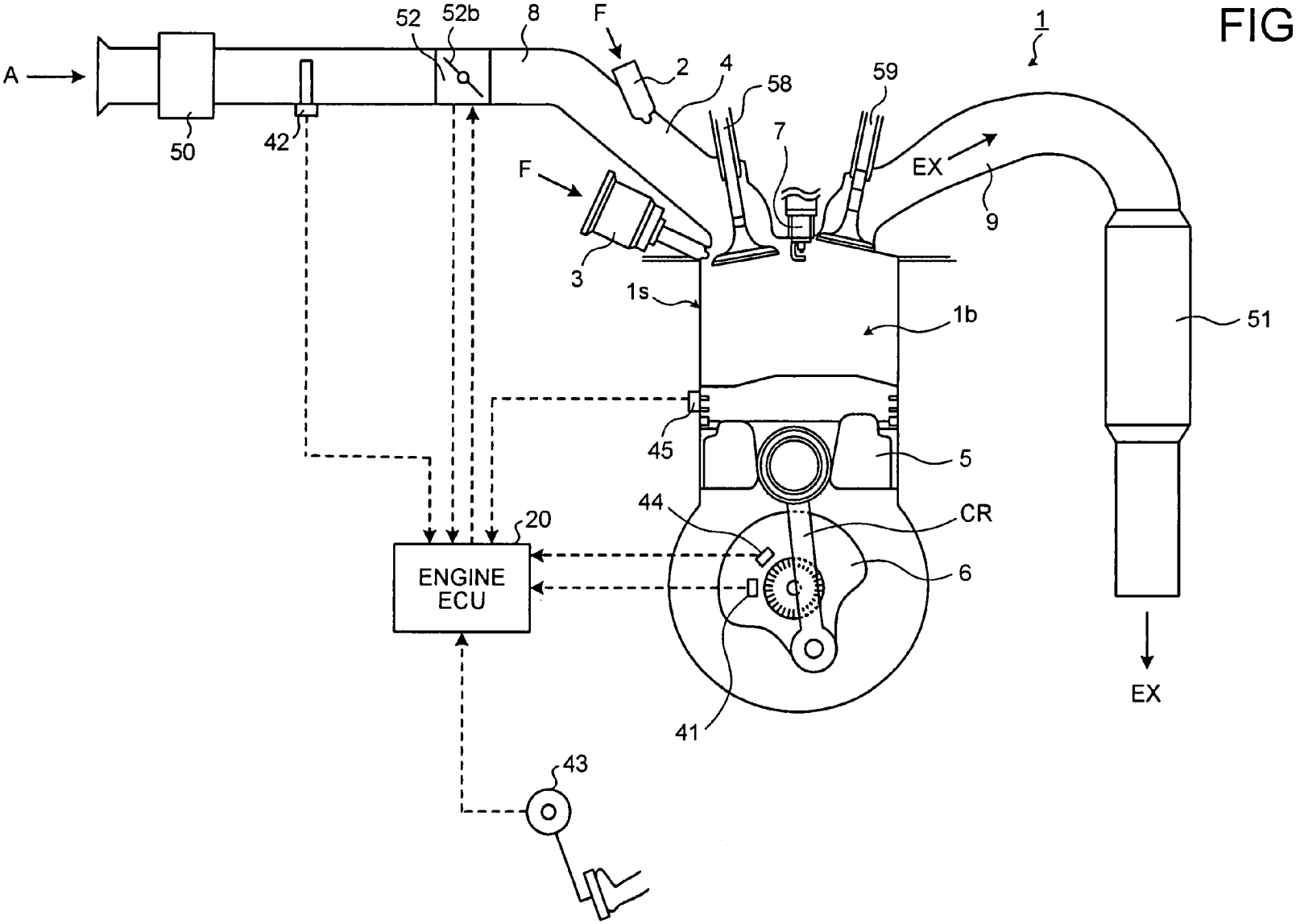
FIG. 1 is for explaining an example of an internal combustion engine according to a first embodiment of the present invention.

FIG. 1 is a diagram for explaining an example of an internal combustion engine to which a control method for an internal combustion engine according to a first embodiment is used. An internal combustion engine 1 that is a target for control in the control method for an internal combustion engine according to the first embodiment is a reciprocating internal combustion engine using gasoline as fuel. For fuel F used to drive the internal combustion engine 1, a port injection valve 2 and a direct injection valve 3 are provided. The port injection valve 2 is used to inject the fuel F into an intake port 4 that is a part of an intake passage and the direct injection valve 3 is used to inject the fuel F directly into a combustion chamber 1*b* of a cylinder 1*s*. As explained above, the internal combustion engine 1 includes a so-called dual injection valve in which fuel is supplied from the port injection valve 2 and the direct injection valve 3, and can operate in both a stratified charge combustion region and a uniform combustion region. The internal combustion engine 1 can also change a fuel injection ratio between the port injection valve 2 and the direct injection valve 3 according to an engine speed NE and a load KL of the internal combustion engine 1.

An air cleaner 50 removes dust and dirt from air A, and an air flow sensor 42 measures a flow rate of the air A. The flow rate of the air to be supplied to the internal combustion engine 1 is controlled by the opening of a butterfly valve 52*b* in an electric throttle valve 52 provided at some midpoint of an intake passage 8. The opening of the butterfly valve 52*b* of the electric throttle valve 52 is controlled by an engine ECU (Electronics Control Unit) 20. The engine ECU 20 decides the amount of fuel and the amount of air to be supplied to the internal combustion engine 1 based on accelerator opening information obtained from an accelerator opening sensor 43. The opening of the butterfly valve 52*b* in the electric throttle valve 52 is controlled so that the amount of air decided is supplied to the internal combustion engine 1. The engine ECU 20 obtains the opening information for the butterfly valve 52*b* and performs feed-back control on the butterfly valve 52*b*.

The air A passing through the electric throttle valve 52 is led to the intake port 4. The air A passing through an intake valve 58 from the intake port 4 is led into the combustion chamber 1*b*, and forms a mixture with the fuel F injected from the port injection valve 2 or the direct injection valve 3. The mixture formed is ignited and burnt due to the sparks from a spark plug 7. The mixture after the burning thereof becomes exhaust gas EX, and the exhaust gas EX passes through an exhaust valve 59 and is discharged to an exhaust passage 9. The exhaust gas EX is led to a catalyst 51 provided in the exhaust passage 9, where it is purified and discharged into air.

Combustion pressure of the mixture is transmitted to a piston 5 to cause the piston 5 to reciprocate. The reciprocal movement of the piston 5 is transmitted to a crankshaft 6 through a connecting rod CR. The reciprocal movement of the piston 5 is converted to a rotational movement by the crankshaft 6, and is taken out as an output of the internal combustion engine 1. A crank angle sensor 41 that detects a rotation angle of the crankshaft 6 is fixed to the internal combustion engine 1. The output of the crank angle sensor 41 is obtained by the engine ECU 20, and a timing of injecting fuel F by the port injection valve 2 or by the direct injection valve 3 is controlled based on a signal as the output. The number of revolutions of the crankshaft 6 of the internal combustion engine 1 is expressed as engine speed NE. The engine speed NE of the internal combustion engine 1 is detected by an engine speed sensor 44 and taken into the engine ECU 20. A knock sensor 45 is fixed to the cylinder 1*s* of the internal combustion engine 1 to detect knocking of the internal combustion engine 1. If knocking occurs in the internal combustion engine 1, the engine ECU 20 acquires a knock detection signal from the knock sensor 45, and delays a spark timing based on the knock detection signal to suppress occurrence of knocking. In other words, the spark timing is shifted to the ignition top dead center side.

The engine ECU 20 acquires output signals detected by the crank angle sensor 41, the accelerator opening sensor 43, the air flow sensor 42, the engine speed sensor 44, the knock sensor 45, and other sensors, and controls the operation of the internal combustion engine 1. The engine ECU 20 controls the operation of the internal combustion engine 1 based on information for the accelerator opening sensor 43. If the engine speed NE of the internal combustion engine 1 is low and the load KL is small, fuel is directly injected from the direct injection valve 3 into the combustion chamber 1*b* and the fuel undergoes stratified charge combustion to suppress fuel consumption. Any other operating condition is such that fuel is injected from the port injection valve 2 into the intake port 4 and the internal combustion engine 1 is operated in what is called the uniform combustion region. Herein, the fuel is injected from the port injection valve 2 into the intake port 4 when the intake valve 58 is closed. In other words, the fuel is injected from the port injection valve 2 in a so-called "intake asynchronous" manner. The fuel is sometimes injected from the direct injection valve 3 also in the uniform combustion region. In this case, the fuel is injected from the direct injection valve 3 during the intake stroke as a rule.

Figure 2:
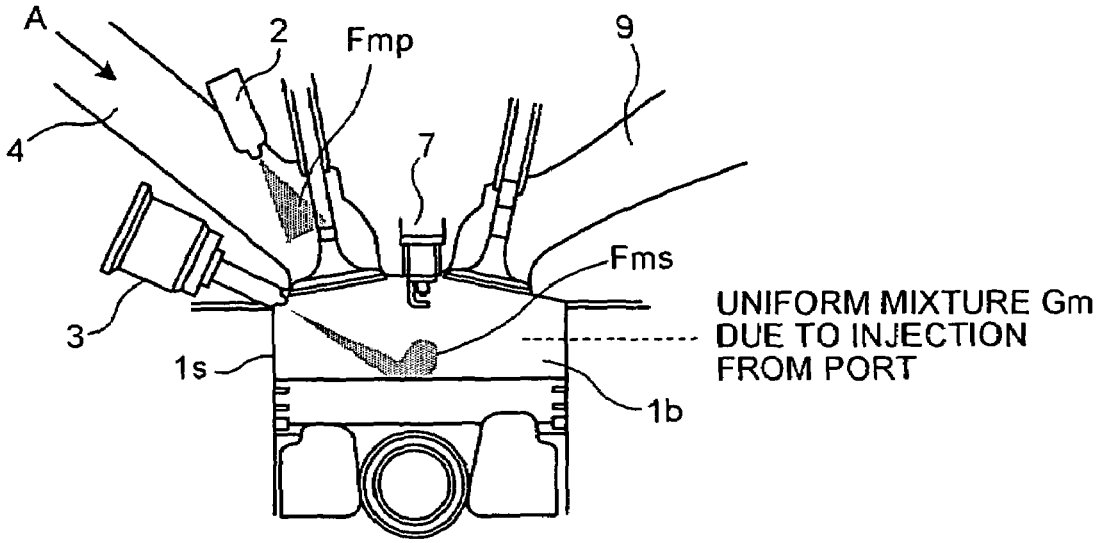
FIG. 2 is a schematic for explaining injection of fuel in the internal combustion engine shown in FIG. 1.
Figure 3:
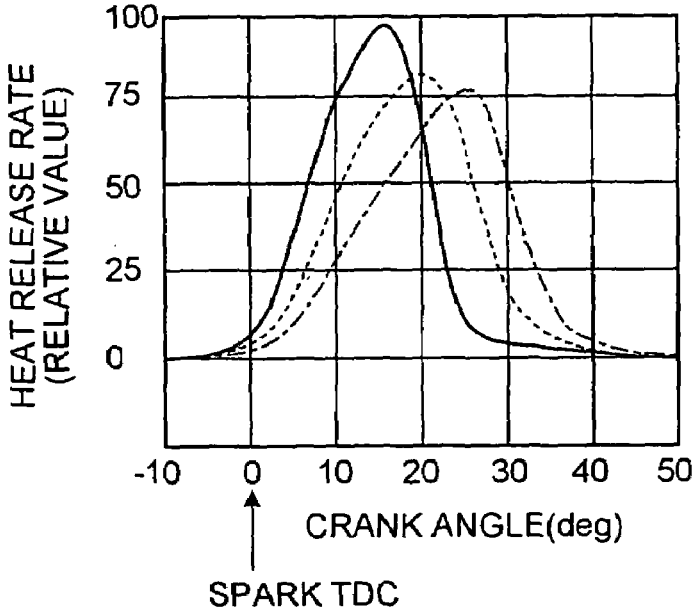
FIG. 3 is a graph of heat release rate and the crank angle.

FIG. 2 is a diagram for explaining injection of fuel from the direct injection valve during the compression stroke of the internal combustion engine. FIG. 3 is a diagram for explaining a relationship between a heat release rate of the internal combustion engine and a crank angle. The solid line of FIG. 3 indicates a heat release rate when fuel is injected from both the port injection valve 2 and the direct injection valve 3 and fuel is injected from the direct injection valve 3 during the compression stroke. The broken line of FIG. 3 indicates a heat release rate when only the direct injection valve 3 is used, and the dashed line of FIG. 3 indicates a heat release rate when only the port injection valve 2 is used.

Knocking easily occurs when uniform combustion is carried out, a load factor (load) of the internal combustion engine 1 is high, and the operation is performed in a region of the low to medium speeds. In such a region, in order to suppress occurrence of knocking, the spark timing by the spark plug 7 needs to be delayed (in a direction in which the spark timing is set earlier than the ignition top dead center), resulting in decrease in torque of the internal combustion engine 1. As shown in FIG. 2, in such an operating region where knocking easily occurs, fuel at a predetermined ratio of the whole amount of fuel injection is injected during the compression stroke, from the direct injection valve 3 of the internal combustion engine 1 that includes the port injection valve 2 and the direct injection valve 3. As shown in FIG. 3, it is understood that the rising edge or the falling edge of an amount of heat generated is sharp as compared with the case where only the port injection valve 2 is used or only the direct injection valve 3 is used. More specifically, if the fuel at a predetermined ratio of the whole amount of fuel injection is injected from the direct injection valve 3 during the compression stroke, a combustion speed of a mixture in the combustion chamber 1*b* is improved as compared with the case where fuel is injected only from the direct injection valve 3 or the port injection valve 2. Consequently, the torque of the internal combustion engine 1 is also improved.

The inventors of the present invention continued studying on the internal combustion engine 1 including the port injection valve and the direct injection valve, more specifically, the fuel injection timing and the fuel injection ratio of the direct injection valve. As a result, the inventors found that the combustion speed of the mixture in the combustion chamber is improved to improve the torque by injecting the fuel at the predetermined ratio of the whole amount of fuel injection during the compression stroke when the uniform combustion is carried out, the load factor of the internal combustion engine 1 is high, and the operation is performed in the region at the low to medium speeds.

Figure 4:
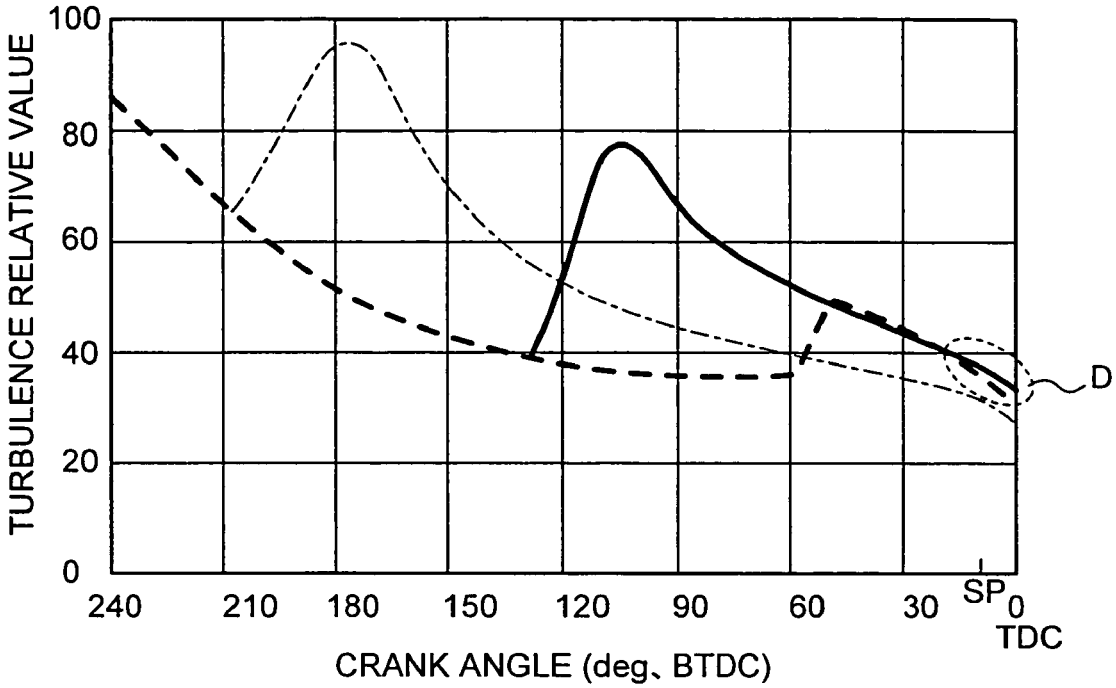
FIG. 4 is a graph for explaining turbulence of the mixture in the combustion chamber at a fuel injection timing of the direct injection valve.

FIG. 4 is a diagram for explaining turbulence of the mixture in the combustion chamber at a fuel injection timing of the direct injection valve. The fuel injection timing is expressed by a crank angle before the top death center (BTDC) of ignition. The solid line and the broken line of FIG. 4 indicate a case where the whole amount of fuel injection is divided by the port injection valve 2 and the direct injection valve 3 to inject respective amounts of fuel and a case where the fuel is injected from the direct injection valve 3 during the compression stroke. More specifically, the solid line of FIG. 4 indicates a change in the turbulence in the combustion chamber when the fuel of which direct injection ratio is 80% is injected at around 130 degrees BTDC. The broken line of FIG. 4 indicates a change in the turbulence in the combustion chamber when the fuel of which direct injection ratio is 20% is injected at around 60 degrees BTDC. The dashed line of FIG. 4 indicates a change in the turbulence in the combustion chamber when the fuel of which direct injection ratio is 100%, i.e., the whole fuel is injected only from the direct injection valve 3 at around 200 degrees BTDC. The turbulence is expressed by a relative value, and it is determined that the mixture in the combustion chamber 1*b* is more disturbed as the value is larger. The results of FIG. 4 are obtained by numerical simulations. A spark timing SP is at around 10 degrees BTDC.

Under all the fuel injection conditions, mixture turbulence in the combustion chamber 1*b* after injection reaches the maximum when about 30 degrees as a crank angle have rotated after injection of the fuel into the combustion chamber 1*b*. Thereafter, the mixture turbulence in the combustion chamber 1*b* decreases to a value at the spark timing SP. Note the mixture turbulence (a portion indicated by reference sign D of FIG. 4) at the spark timing SP. It is found that when the whole amount of fuel injected is divided and injected by the port injection valve 2 and the direct injection valve 3 and fuel is injected from the direct injection valve 3 during the compression stroke, the mixture turbulence in the combustion chamber 1*b* becomes larger at near the spark timing SP as compared with the case where the whole amount of fuel is injected only from the direct injection valve 3. This is, presumably, caused by the following reason. That is, fuel is directly injected to a uniform mixture Gm (see FIG. 2) by port injection that is led into the combustion chamber 1*b*, and fuel spray Fms (see FIG. 2) after the direct injection penetrates the uniform mixture Gm in the combustion chamber 1*b* to agitate it. At the same time, since the fuel spray by the direct injection mixes the surrounding uniform mixture, uneven distribution of the uniform mixture and the mixture due to direct injection is reduced. This allows the uniform mixture to be agitated and mixed sufficiently, thus improving the combustion speed. The present invention is provided to make active use of the mixture turbulence in the combustion chamber and improve the torque of the internal combustion engine 1. In order that the fuel spray Fms due to direct injection penetrates the uniform mixture Gm in the combustion chamber 1*b*, the direct injection valve 3 is used so that a fuel spray with high penetration force can be formed. For example, a fan spray, a slit nozzle, or so is preferably used.

If the fuel injection ratio of the direct injection valve 3 is larger (80% in the example of FIG. 4), the degree of turbulence of the uniform mixture in the combustion chamber 1*b* becomes larger. However, even if the fuel injection ratio is smaller (20% in the example of FIG. 4), by injecting fuel from the direct injection valve 3 at a timing closer to the spark timing SP, it is possible to increase the degree of turbulence of the mixture in the combustion chamber 1*b* as compared with that of the case where only the direct injection valve 3 is used.

Figure 5:
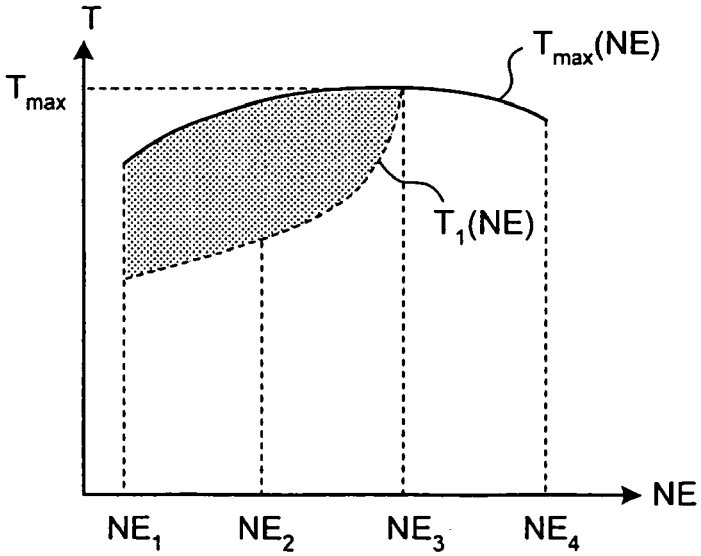
FIG. 5 is a diagram for explaining a region where fuel is injected from the direct injection valve during the compression stroke according to the first embodiment.

FIG. 5 is a diagram for explaining a region where fuel is injected from the direct injection valve during the compression stroke according to the first embodiment. FIG. 5 depicts the region where fuel at a predetermined ratio of the whole amount of fuel is injected from the direct injection valve 3 during the compression stroke based on a relationship between the torque of the internal combustion engine and the engine speed. The operation control of the internal combustion engine 1 according to the first embodiment is preferably used in a region where uniform combustion is carried out, the engine speed NE is a medium speed or less, particularly, a low speed, and the load factor KLr of the internal combustion engine 1 is 75% or more. The region where the load factor KLr is 75% or more is a region of what is called WOT (Wide Open Throttle), where the internal combustion engine 1 is operated at a high load. From the viewpoint of the magnitude of torque generated, when the operation control of the internal combustion engine according to the first embodiment is applied, an air-fuel ratio is preferably from 11 to 13, more preferably about 12.5.

As explained above, when the internal combustion engine 1 is operated at a high load and at low to medium speeds, knocking easily occurs. If knocking occurs, the spark timing is delayed to protect the internal combustion engine 1, however, this results in a decrease in the torque of the internal combustion engine 1. The operation control method for the internal combustion engine according to the first embodiment is particularly effective under such an operating condition that knocking easily occurs. Thus, it is possible to improve torque of the internal combustion engine 1 while suppressing occurrence of knocking. Since knocking easily occurs if intake air is supercharged, the operation control for the internal combustion engine according to the first embodiment is preferably used for operation control for an internal combustion engine that includes a turbocharger or a supercharger.

In the example as shown in FIG. 5, referring to the engine speed NE, assuming that the maximum engine speed of the internal combustion engine 1 is $NE_4$, a range up to an engine speed $NE_3$ that is about two-thirds of the maximum engine speed $NE_4$ corresponds to a medium speed. Furthermore, a range up to an engine speed $NE_2$ that is about one-third of the maximum engine speed $NE_4$ corresponds to a low engine speed. The load factor KLr indicates a ratio T1/Tmax between torque T1 and maximum torque Tmax. The torque T1 is generated in the internal combustion engine 1 when the engine speed is a certain engine speed $NE_{T1}$, and the torque Tmax is generated in the internal combustion engine 1 when accelerator opening is fully opened at the same engine speed $NE_{T1}$. Although the load factor KLr is used to determine the load of the internal combustion engine 1, the load of the internal combustion engine 1 may be determined by some other means such as a filling rate of the internal combustion engine 1 (which indicates a rate of air filled with respect to the air mass at the bottom dead center of the piston at 35° C. and 1 air pressure), Q/N (air mass per one rotation), the accelerator opening, or so.

Figure 6:
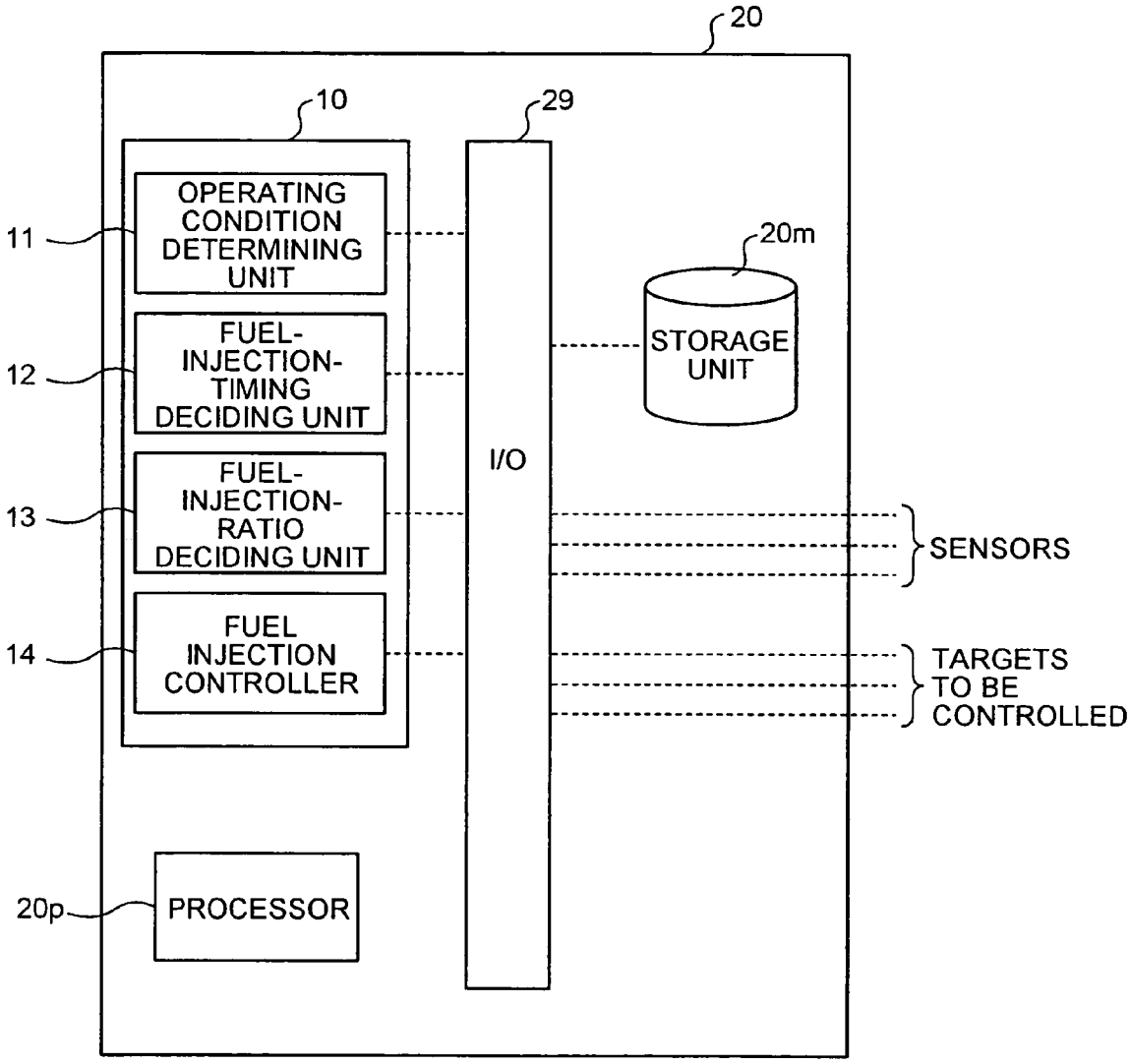
FIG. 6 is functional block diagram of an apparatus for controlling the internal combustion engine shown in FIG. 1.

FIG. 6 is a functional block of an operation control apparatus for controlling the internal combustion engine according to the first embodiment. An operation control method for the internal combustion engine according to the first embodiment is realized by an operation control apparatus 10 for an internal combustion engine according to the first embodiment. The operation control apparatus 10 is incorporated in the engine ECU 20. It is noted that the operation control apparatus 10 may be prepared separately from the engine ECU 20 and connected to the engine ECU 20. For realizing the operation control method for the internal combustion engine according to the first embodiment, the control function of the internal combustion engine 1 included in the engine ECU 20 may be configured so as to be used by the operation control apparatus 10.

The operation control apparatus 10 includes an operating condition determining unit 11, a fuel-injection-timing deciding unit 12, a fuel-injection-ratio deciding unit 13, and a fuel injection controller 14. These components form a portion where the operation control method for the internal combustion engine according to the first embodiment is executed. The operating condition determining unit 11, the fuel-injection-timing deciding unit 12, the fuel-injection-ratio deciding unit 13, and the fuel injection controller 14 are connected to one another through an input/output port (I/O) 29 of the engine ECU 20. Consequently, the operating condition determining unit 11, the fuel-injection-timing deciding unit 12, the fuel-injection-ratio deciding unit 13, and the fuel injection controller 14 are possible to bi-directionally transmit and receive data. Furthermore, data may be uni-directionally transmitted or received if it is necessary for the configuration (hereinafter the same).

The operation control apparatus 10 is connected to a processor 20*p* and a storage unit 20*m* of the engine ECU 20 through the input/output port (I/O) 29 that is included in the engine ECU 20, and data can be mutually exchanged between them. With this configuration, the operation control apparatus 10 can acquire the load and the engine speed of the internal combustion engine 1 obtained by the engine ECU 20 and some other operation control data for the internal combustion engine. Furthermore, the operation control apparatus 10 can cause control for the operation control apparatus 10 to be interrupted in an operation control routine for the internal combustion engine of the engine ECU 20.

The crank angle sensor 41, the air flow sensor 42, the accelerator opening sensor 43, and other sensors that acquire information for operation of the internal combustion engine 1 are connected to the input/output port (I/O) 29. With this configuration, the engine ECU 20 and the operation control apparatus 10 can acquire information required for operation control for the internal combustion engine 1. Furthermore, an injection valve control unit and some other targets for control of the internal combustion engine 1 are connected to the input/output port (I/O) 29. The injection valve control unit controls a fuel injection ratio and a fuel injection timing of the electric throttle valve 52, the port injection valve 2, and the direct injection valve 3. These operations are controlled by the processor 20*p* of the engine ECU 20 based on signals from the sensors that acquire information for the operation of the internal combustion engine 1.

The storage unit 20*m* stores a computer program including a process procedure of the operation control method for the internal combustion engine according to the first embodiment, and also stores data map for the amount of fuel injection used for controlling the operation of the internal combustion engine 1. The storage unit 20*m* can be configured by a volatile memory such as RAM (Random Access Memory), a nonvolatile memory such as a flash memory, or in combination with these. The operation control apparatus 10 and the processor 20*p* of the engine ECU 20 can be configured by a memory and a CPU (Central processing unit).

The computer program may be combined with any computer program having been recorded in the operating condition determining unit 11 and the fuel-injection-timing deciding unit 12 to realize the process procedure of the operation control method for the internal combustion engine according to the first embodiment. The operation control apparatus 10 may use specific hardware instead of the computer program to realize the functions of the operating condition determining unit 11, the fuel-injection-timing deciding unit 12, the fuel-injection-ratio deciding unit 13, and the fuel injection controller 14. The operation control method for the internal combustion engine according to the first embodiment is explained below with reference to FIG. 1 to FIG. 6 if necessary.

Figure 7:
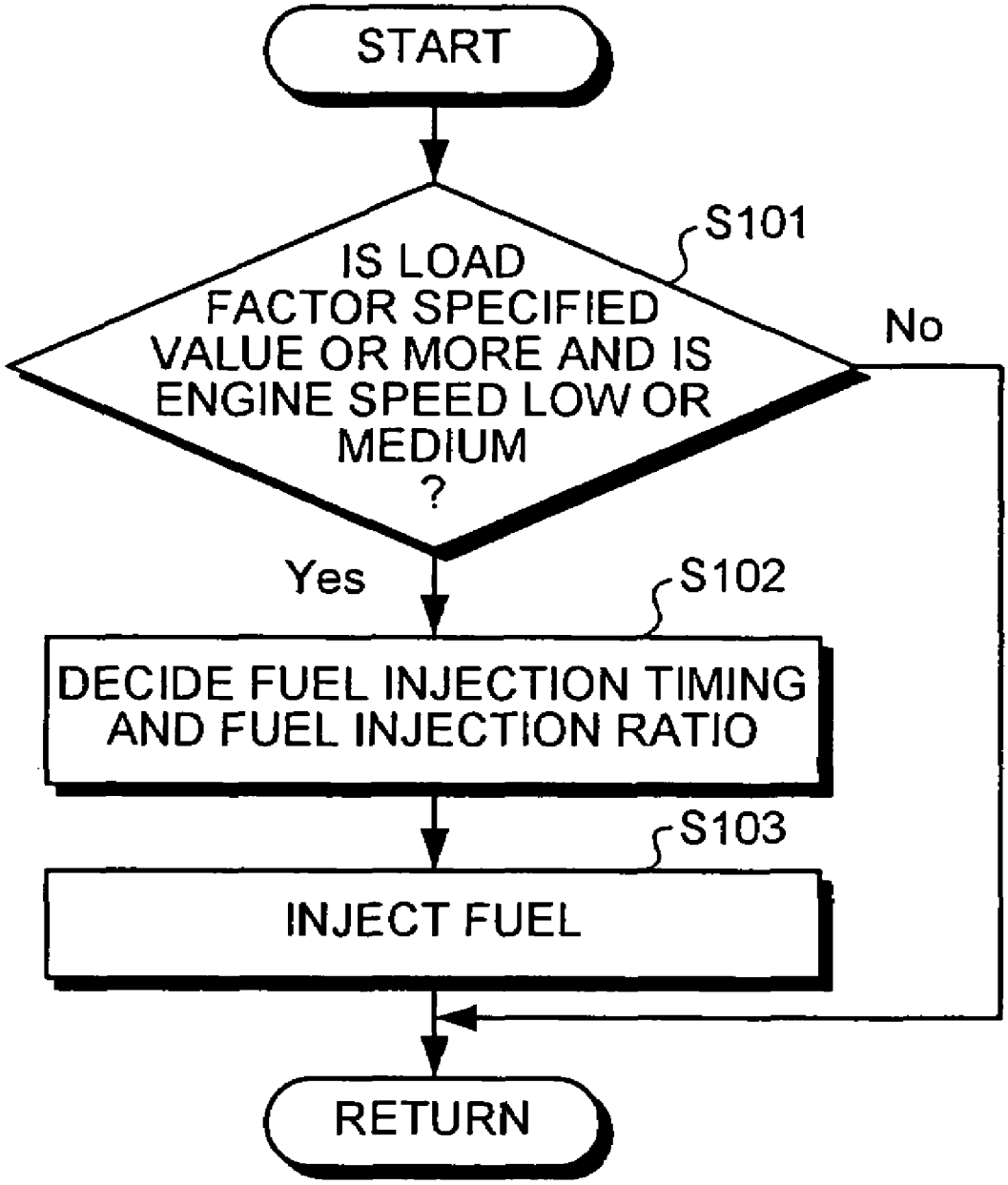
FIG. 7 is a flowchart of the process procedure of a method for controlling the internal combustion engine shown in FIG. 1.

FIG. 7 is a flowchart of a process procedure of a method for controlling the internal combustion engine according to the first embodiment. For executing the operation control for the internal combustion engine according to the first embodiment, the operating condition determining unit 11 included in the operation control apparatus 10 determines whether the load factor KLr of the internal combustion engine 1 is a specified value or more and the engine speed NE is between low to medium speeds (step S101). The specified value used to determine the load factor KLr is set to load factor KLr=75% or more. Under such a condition, knocking easily occurs, and if occurrence of knocking is tried to be suppressed, the spark timing SP has to be delayed, which results in reduction in torque. By executing the operation control for the internal combustion engine according to the first embodiment under the condition, the combustion speed is improved and knocking can be suppressed. Therefore, the spark timing SP can be advanced. This allows torque to be improved while suppressing knocking.

If at least one of a case where the load factor KLr of the internal combustion engine 1 is less than the specified value and a case where the engine speed NE is high speed is satisfied (step S101; No), the operation control apparatus 10 continues monitoring how the internal combustion engine 1 is operating. At this time, the internal combustion engine 1 operates in the stratified charge combustion region or the uniform combustion region. In the stratified charge combustion region, the whole fuel is injected from the direct injection valve 3 to the internal combustion engine 1 during the compression stroke. The fuel-injection-timing deciding unit 12 decides a fuel injection timing of the direct injection valve 3, and the fuel-injection-ratio deciding unit 13 decides a fuel injection ratio of the direct injection valve 3 (100% in this case). The fuel injection controller 14 causes fuel to be injected from the direct injection valve 3 at the fuel injection timing and the fuel injection ratio.

In the uniform combustion region, fuel is injected into the internal combustion engine 1 from the port injection valve 2 alone or in combination with the direct injection valve 3. When the port injection valve 2 and the direct injection valve 3 are used in combination with each other, fuel is injected into the internal combustion engine 1 from the direct injection valve 3 during the intake stroke. The fuel injection ratio between the port injection valve 2 and the direct injection valve 3 is decided according to the load factor KLr of the internal combustion engine 1 and the engine speed NE and so on. The fuel-injection-timing deciding unit 12 decides a fuel injection timing of the direct injection valve 3, and the fuel-injection-ratio deciding unit 13 decides a fuel injection ratio of the direct injection valve 3. The fuel injection controller 14 causes fuel to be injected from the port injection valve 2 or from the port injection valve 2 and the direct injection valve 3 at the fuel injection timing and the fuel injection ratio decided.

Figure 8A:
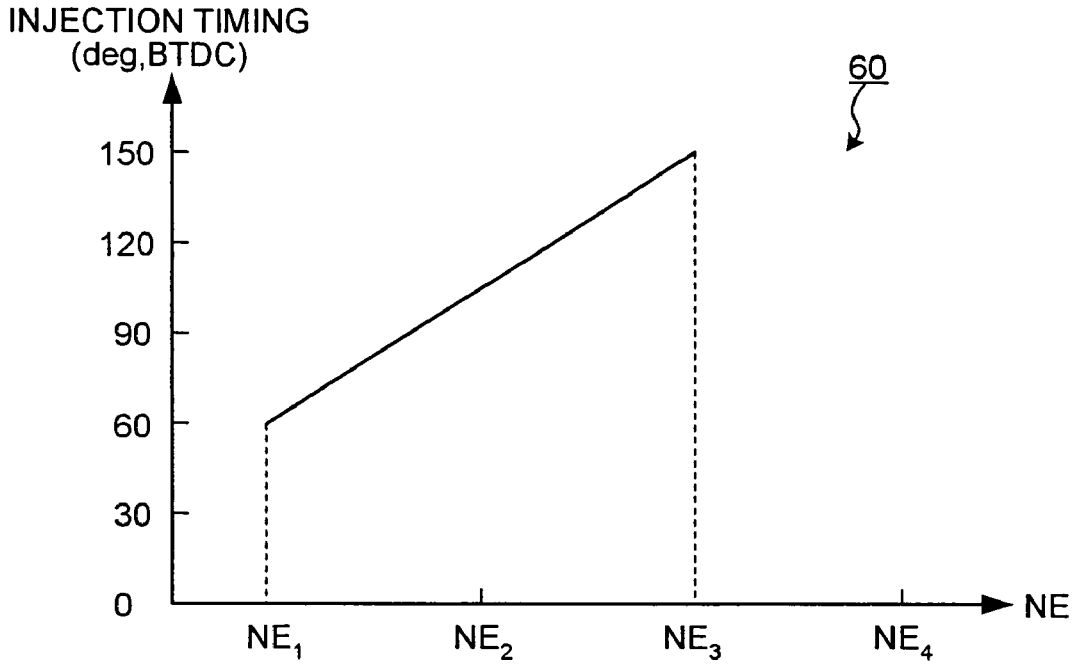
FIG. 8A is a map of the fuel injection timing of the direct injection valve and the engine speed.
Figure 8B:
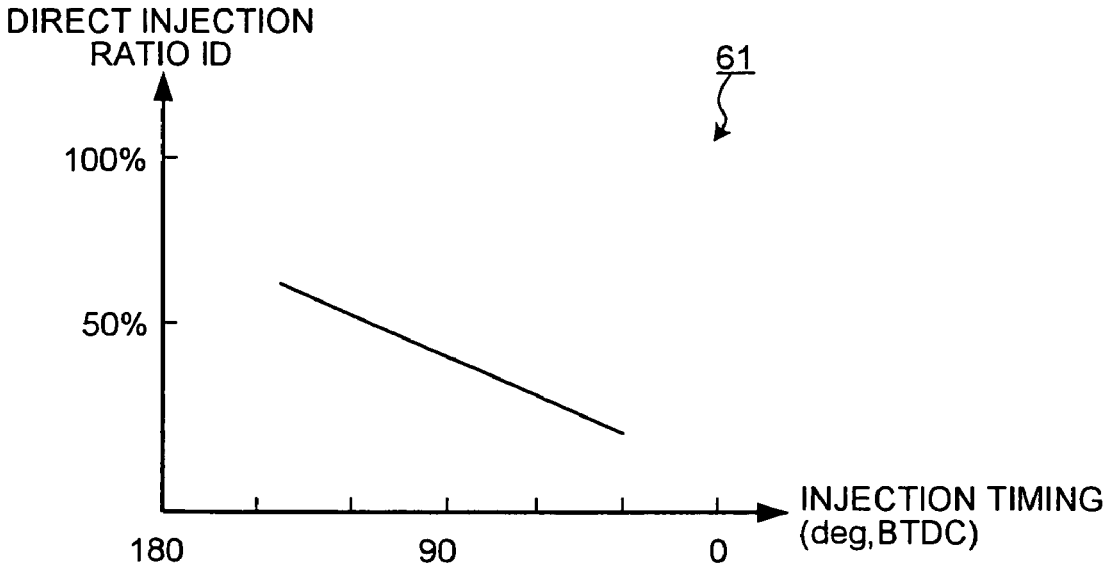
FIG. 8B is a map of the fuel injection ratio and the fuel injection timing of the direct injection valve.

If the load factor KLr of the internal combustion engine 1 is not less than the specified value and the engine speed NE is the low to medium speeds (step S101; Yes), the fuel-injection-timing deciding unit 12 decides a fuel injection timing of the direct injection valve 3, and the fuel-injection-ratio deciding unit 13 decides a fuel injection ratio of the direct injection valve 3 (step S102). The method of this is explained below. FIG. 8A is a map of the fuel injection timing of the direct injection valve and the engine speed. FIG. 8B is a map of the fuel injection ratio and the fuel injection timing of the direct injection valve.

In the first embodiment, fuel is injected from the direct injection valve 3 into the combustion chamber 1*b* during the compression stroke. If the engine speed NE is low, it is possible to ensure some amount of time for forming a mixture in the combustion chamber 1*b* with the fuel injected from the direct injection valve 3. Therefore, when the engine speed NE is low, fuel can be injected at a later timing in the compression stroke, i.e., at the timing closer to the ignition top dead center. On the other hand, if the engine speed NE is high, the time for forming the mixture in the combustion chamber 1*b* with the fuel injected from the direct injection valve 3 is made shorter. Therefore, when the engine speed is high, the fuel can be injected at an earlier timing in the compression stroke, i.e., at the timing that is separated from the ignition top dead center. FIG. 8A is a direct-injection-timing decision map 60 indicating the relationship. In the direct-injection-timing decision map 60, the fuel injection timing of the direct injection valve 3 (direct injection timing) is shifted toward an advance angle side as the engine speed NE increases. For deciding the fuel injection timing of the direct injection valve 3, the fuel-injection-timing deciding unit 12 provides the engine speed NE acquired to the direct-injection-timing decision map 60 to decide a direct injection timing corresponding to the engine speed NE.

As explained above, even if the fuel injection ratio of the direct injection valve 3 is low, by making the fuel injection timing of the direct injection valve 3 closer to the spark timing SP, the mixture turbulence in the combustion chamber 1*b* can be increased. On the other hand, if the fuel injection timing of the direct injection valve 3 is close to the beginning of the compression stroke, then the fuel injection ratio of the direct injection valve 3 is increased, which allows the mixture turbulence in the combustion chamber 1*b* to increase at the spark timing SP. Therefore, the fuel injection ratio of the direct injection valve 3 is increased more as the fuel injection timing of the direct injection valve 3 is shifted toward the beginning (near 180 degrees BTDC) of the compression stroke. An injection-ratio decision map 61 as shown in FIG. 8B is configured in the above manner. For deciding the fuel injection ratio of the direct injection valve 3, the fuel-injection-ratio deciding unit 13 acquires the direct injection timing decided by the fuel-injection-timing deciding unit 12, provides the direct injection timing acquired to the injection-ratio decision map 61, and decides a fuel injection ratio of the direct injection valve 3. The direct-injection-timing decision map 60 and the injection-ratio decision map 61 are stored in the storage unit 20*m* of the engine ECU 20.

Although the fuel injection timing of the direct injection valve 3 is decided here according to the engine speed NE and the fuel injection ratio of the direct injection valve 3 is decided according to the fuel injection timing decided, the fuel injection ratio and the fuel injection timing of the direct injection valve 3 may be previously decided as fixed values. The fuel injection ratio of the direct injection valve 3 may be previously decided to change the fuel injection timing according to the engine speed NE. Alternatively, the fuel injection timing of the direct injection valve 3 may be previously decided to change the fuel injection ratio according to the engine speed NE. Furthermore, the fuel injection ratio of the direct injection valve 3 may be decided according to the engine speed NE to decide the fuel injection timing of the direct injection valve 3 according to the fuel injection ratio decided. The engine speed NE is used as a decision parameter to decide the fuel injection timing and the fuel injection ratio of the direct injection valve 3. In addition, the load factor KLr of the internal combustion engine 1, the signal of the knock sensor 45, and some other information may be used as decision parameters.

In all the methods, the operating condition determining unit 11 determines whether the load factor KLr of the internal combustion engine 1 is not less than the specified value and determines whether the engine speed NE is the low to medium speeds. Based on the results of determination, the fuel-injection-timing deciding unit 12 decides the fuel injection timing of the direct injection valve 3, and the fuel-injection-ratio deciding unit 13 decides the fuel injection ratio of the direct injection valve 3. It is noted that a fuel injection ratio Y of the port injection valve 2 is Y=(100−X) %, where X % is a fuel injection ratio of the direct injection valve 3. The fuel injection amount of the port injection valve 2 is the remaining amount obtained by subtracting a fuel injection amount injected by the direct injection valve 3 from the whole fuel injection amount. The fuel injection amount injected by the direct injection valve 3 can be obtained based on the fuel injection ratio of the direct injection valve 3 and the whole fuel injection amount. When the fuel injection timing and the fuel injection ratio of the direct injection valve 3 is decided (step S102), the fuel injection controller 14 causes the direct injection valve 3 to inject fuel at the fuel injection timing and the fuel injection ratio decided (step S103).

Figure 9A:
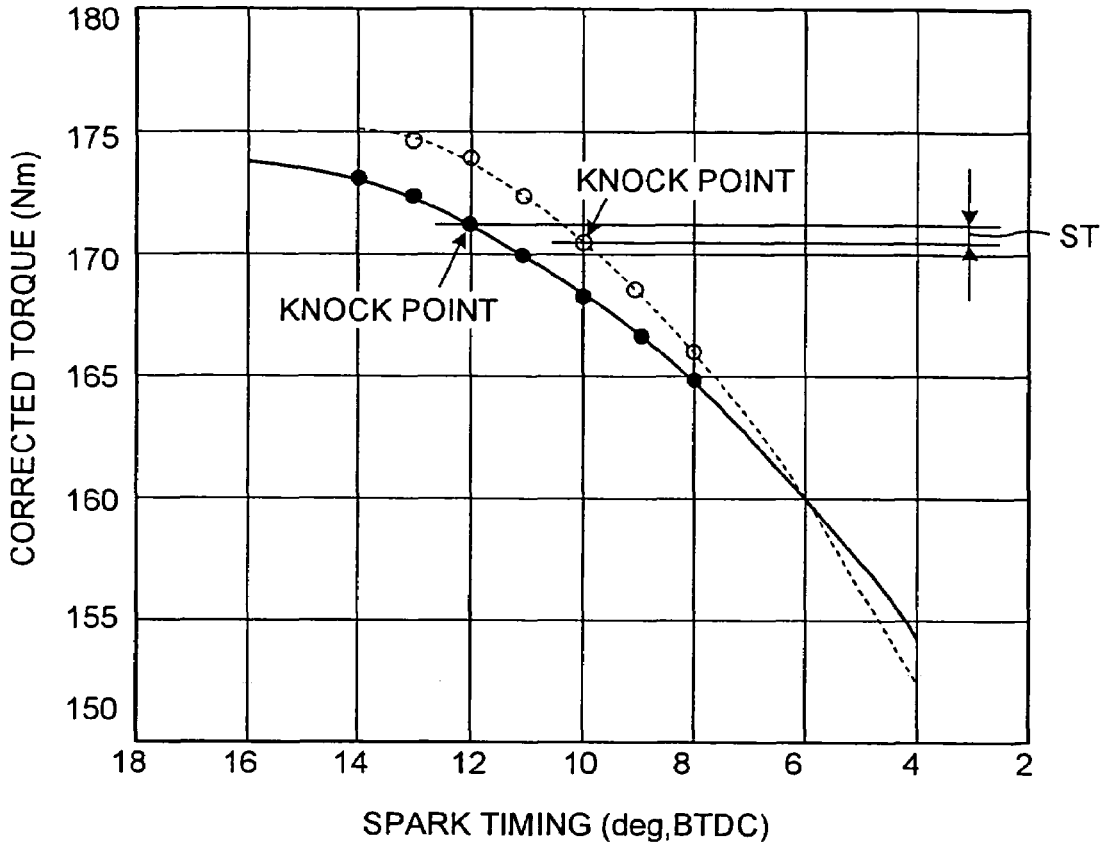
FIG. 9A is a graph of the corrected torque and the spark timing according to the first embodiment.
Figure 9B:
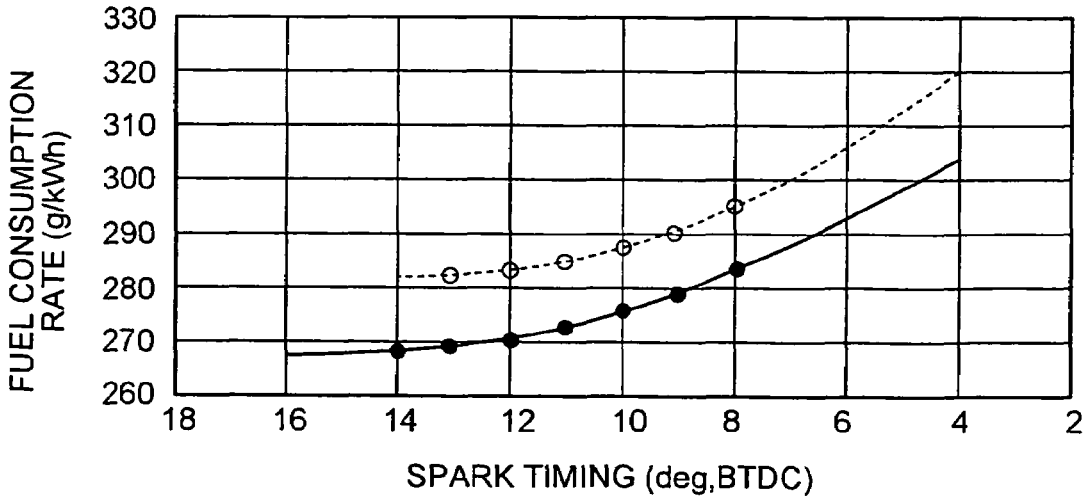
FIG. 9B is a graph of the fuel consumption rate and the spark timing according to the first embodiment.

FIG. 9A is a diagram for explaining a relationship between torque and a spark timing when the operation control method for the internal combustion engine according to the first embodiment is used. FIG. 9B is a diagram for explaining a relationship between a fuel consumption rate and a spark timing when the operation control method for the internal combustion engine according to the first embodiment is used. The solid line of both of the figures indicates the case where the operation control method for the internal combustion engine according to the first embodiment is used, while the broken line thereof indicates the case where the fuel injection ratio of the direct injection valve 3 is 100%. The conditions of the operation control method for the internal combustion engine according to the first embodiment are such that the fuel injection ratio of the direct injection valve 3 is 40% and the fuel injection timing is 140 degrees BTDC.

As shown in FIG. 9A, in the operation control method for the internal combustion engine according to the first embodiment, a point at which knocking occurs (hereinafter, "knock point") is shifted toward the advance angle side as compared with the case where the direct injection ratio is 100%. Comparison is made between knock points, and it is found that larger torque is generated by ST in the case where the operation control method for the internal combustion engine according to the first embodiment is used. In the case of the direct injection ratio of 100%, the internal combustion engine 1 cannot be operated unless the spark timing SP is set to a delay angle side more than 10 degrees BTDC. However, in the operation control method for the internal combustion engine according to the first embodiment, the internal combustion engine 1 can be operated by advancing the spark timing SP up to 12 degrees BTDC. Therefore, when the internal combustion engine 1 is operated while avoiding occurrence of knocking, the operation control method for the internal combustion engine according to the first embodiment allows larger torque to be generated from the internal combustion engine 1 as compared with that of the case where the direct injection ratio is 100%. Therefore, the torque is improved while suppressing occurrence of knocking in the operating region where the knocking easily occurs. It is understood from FIG. 9B that the operation control method for the internal combustion engine according to the first embodiment allows the fuel consumption rate to be suppressed to a value lower than the case where the direct injection ratio is 100%.

In the first embodiment, fuel is injected from both the port injection valve and the direct injection valve in the operating region at the low to medium speeds and the high load where the knocking easily occurs, and fuel is injected from the direct injection valve during the compression stroke. This causes the mixture in the combustion chamber to be agitated and disturbed, thus improves the combustion speed of the mixture in the combustion chamber. As a result, it is possible to improve the torque while suppressing knocking even in the operating region where the knocking easily occurs. Furthermore, the fuel consumption rate can be suppressed to a low level. The configuration of the first embodiment can be used in the following embodiments as required. Accordingly, the same function and effect of the first embodiment can be achieved in the following embodiments having the same configuration as that of the first embodiment.

In an internal combustion engine according to a second embodiment, a fuel injection timing is controlled by the operation control method or the operation control apparatus for the internal combustion engine according to the first embodiment, and a cavity is provided in the top part of the piston of the internal combustion engine. Fuel is injected into the cavity to promote turbulence of uniform mixture Gm in a combustion chamber, thus further improving the combustion speed of the mixture.

Figure 10A:
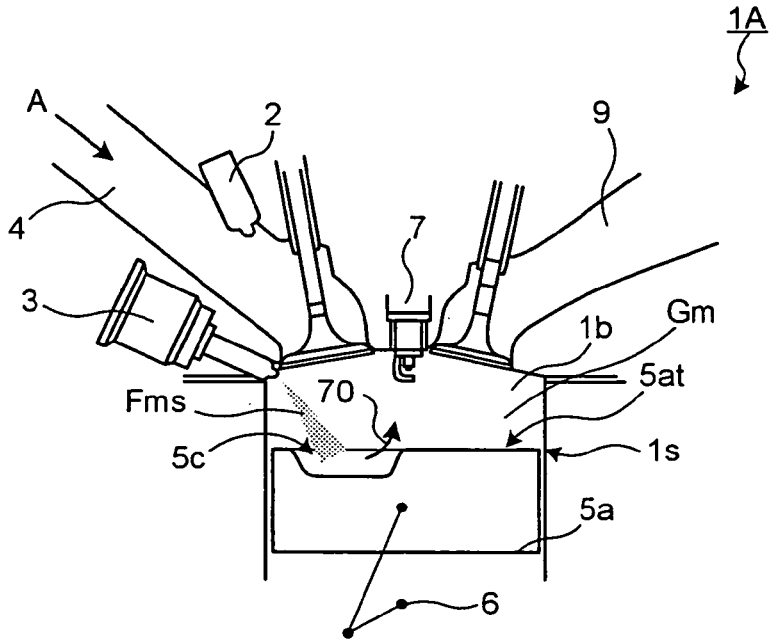
FIG. 10A is a cross section of an internal combustion engine according to a second embodiment of the present invention.
Figure 10B:
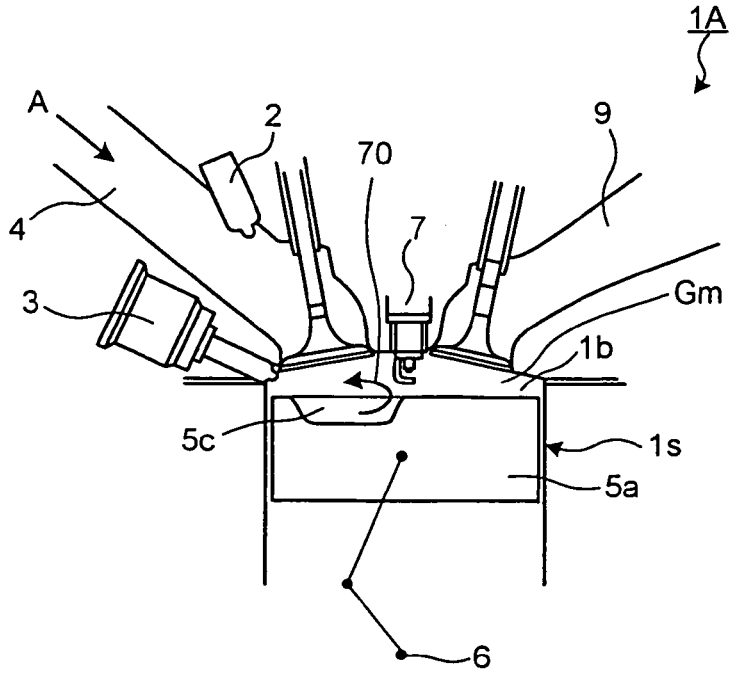
FIG. 10B is a cross section of the internal combustion engine shown in FIG. 10A in the compression stroke.

FIG. 10A and FIG. 10B are cross sections of a piston of an internal combustion engine A1 according to the second embodiment. The piston 5*a* has a cavity 5*c* at a top part 5*at*. A fuel spray Fms is injected from the direct injection valve 3 in the cavity 5*c*. As shown in FIG. 10A, the fuel spray Fms injected toward the cavity 5*c* from the direct injection valve 3 during the compression stroke is whirled up in a direction of arrow 70. As shown in FIG. 10B, the fuel spray forms a swirl flow in the cavity 5*c* in the direction of the arrow 70 while the piston 5*a* is moving to the ignition top dead center.

This swirl flow promotes the turbulence of the uniform mixture Gm that is formed with the fuel injected from the port injection valve 2 and is taken into the combustion chamber 1*b*, and promotes mixing of the fuel spray Fms from the direct injection valve 3. Moreover, the fuel injected from the direct injection valve 3 collides against the bottom of the cavity 5*c* to be atomized, which allows mixing of air with the fuel injected from the direct injection valve 3 to be promoted. As a result, it is possible to further improve the combustion speed of the mixture in the combustion chamber 1*b* and to improve the torque while suppressing occurrence of knocking.

An internal combustion engine according to a third embodiment of the present invention includes a piston with a plurality of cavities. The rest of the components are the same as these of the second embodiment, and therefore, explanation thereof is omitted and the same reference signs are assigned to the same components.

Figure 11A:
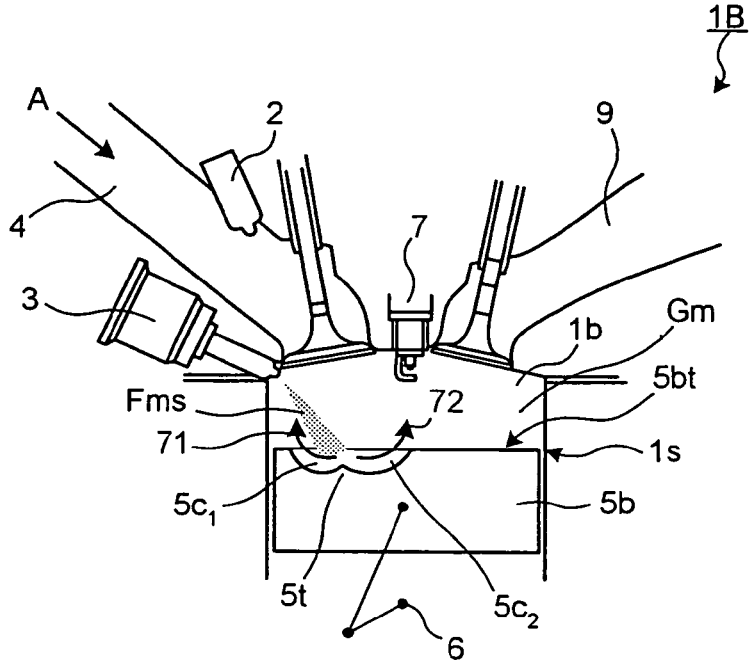
FIG. 11A is a cross section of an internal combustion engine according to a third embodiment of the present invention.
Figure 11B:
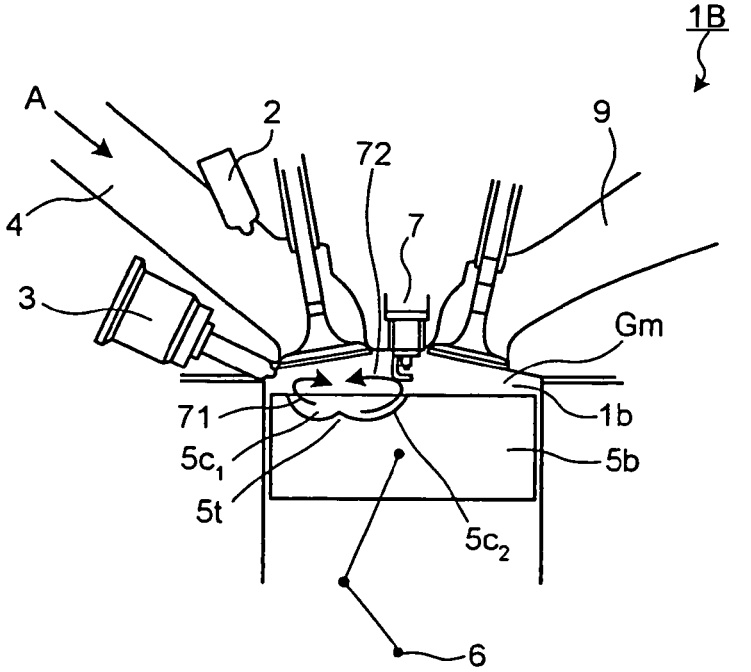
FIG. 11B is a cross section of the internal combustion engine shown in FIG. 11A in the compression stroke.

FIG. 11A and FIG. 11B are cross sections of a piston 5*b* of an internal combustion engine 1B according to the third embodiment. As shown in FIG. 11A and FIG. 11B, the piston 5*b* has a first cavity 5*c*, and a second cavity $\mathbf{5}c_2$. A boundary between the first cavity $\mathbf{5}c_1$ and the second cavity $\mathbf{5}c_2$ projects upward higher than the maximum depth of both the cavities, and forms a projection (or ridge) 5*t*.

As shown in FIG. 11A, fuel is injected from the direct injection valve 3 toward the first cavity $\mathbf{5}c_1$ and the second cavity $\mathbf{5}c_2$ during the compression stroke. At this time, the fuel is preferably injected so as to collide against the projection 5*t*. The fuel spray Fms injected to the first cavity $\mathbf{5}c_1$ and the second cavity $\mathbf{5}c_2$ whirls up in directions of arrow 71 and arrow 72, respectively. As shown in FIG. 11B, the fuel spray forms swirl flows in the first cavity $\mathbf{5}c_1$ and the second cavity $\mathbf{5}c_2$ in the directions of the arrows 71 and 72 while the piston 5*b* is moving to the ignition top dead center.

These two swirl flows promote the turbulence of the uniform mixture Gm that is formed with the fuel injected from the port injection valve 2 and is taken into the combustion chamber 1*b*, and promote mixing of the fuel spray Fms from the direct injection valve 3. Moreover, the fuel injected from the direct injection valve 3 collides against the projection 5*t* to be atomized, which allows mixing of air with the fuel injected from the direct injection valve 3 to be promoted. As a result, it is possible to further improve the combustion speed of the mixture in the combustion chamber 1*b* and to improve the torque while suppressing occurrence of knocking.

An internal combustion engine according to a fourth embodiment of the present invention includes a piston with a cavity and fuel is injected from the direct injection valve 3 so that the fuel spray Fms is formed as a swirl flow in the cavity. The rest of the components are the same as these of the second embodiment, and therefore, explanation thereof is omitted and the same reference signs are assigned to the same components.

Figure 12A:
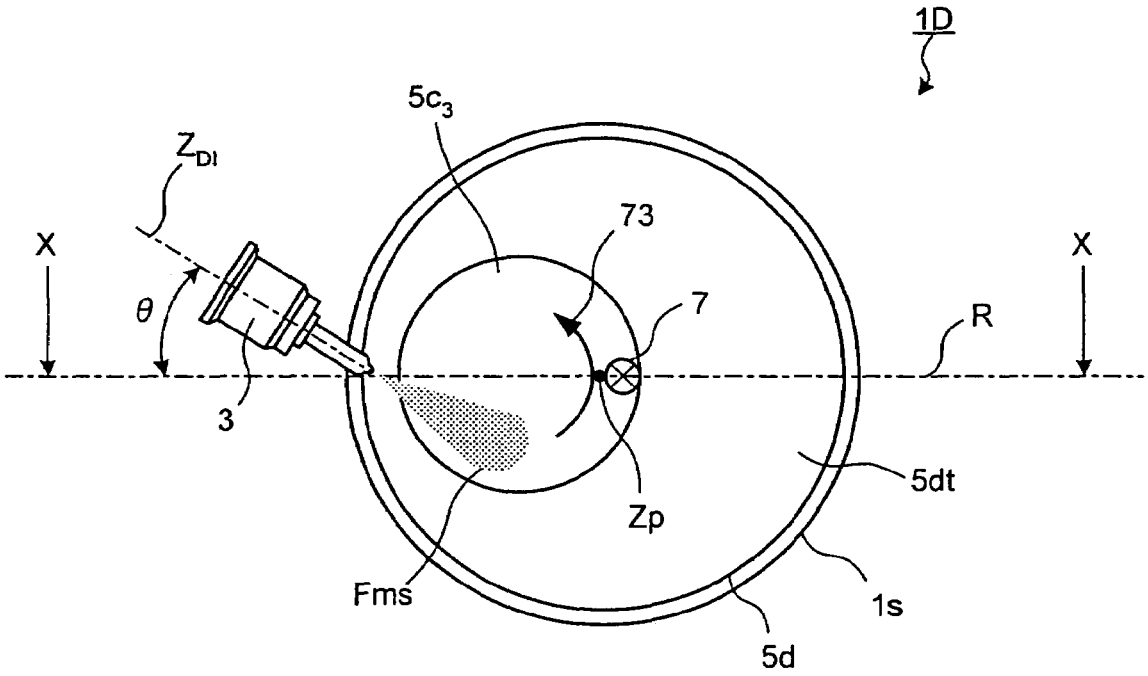
FIG. 12A is a plan view of a piston of an internal combustion engine according to a fourth embodiment.
Figure 12B:
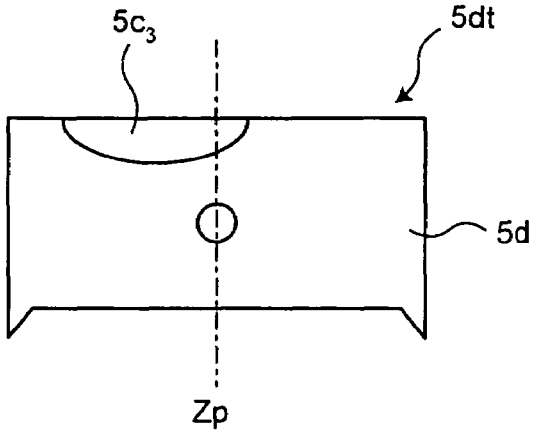
FIG. 12B is a cross section of the piston along line X—X shown in FIG. 12A.

FIG. 12A is a plan view of a piston 5*d* of an internal combustion engine 1D according to the fourth embodiment. FIG. 12B is a cross section taken along line X—X of FIG. 12A. As shown in FIG. 12A and FIG. 12B, the piston 5*d* has a cavity $\mathbf{5}c_3$ in a top part 5*dt*. As shown in FIG. 12A, an injection axis $Z_{DI}$ of the direct injection valve 3 is tilted by a tilt angle θ with respect to a central line R passing through a central axis Zp of the piston 5*d*. Based on this, the fuel spray Fms injected from the direct injection valve 3 is tilted by the tilt angle θ with respect to the central axis Zp of the piston 5*d* and enters the cavity $\mathbf{5}c_3$. Instead of making the direct injection valve 3 tilted, it is also possible to tilt a fuel injection port to form the tilt angle θ, and to tilt the fuel spray Fms by the tilt angle θ with respect to the central axis Zp of the piston 5*d*.

Because of such an arrangement, as shown in FIG. 12A, the fuel spray Fms is swirled in the direction of arrow 73 in the cavity $\mathbf{5}c_3$ to form a swirl flow toward the combustion chamber of the internal combustion engine 1D. This swirl flow promotes the turbulence of a uniform mixture that is formed with the fuel injected from the port injection valve 2 and is taken into the combustion chamber, and promotes mixing of the fuel spray Fms from the direct injection valve 3. Moreover, the fuel injected from the direct injection valve 3 is atomized during the process of forming the swirl flow in the cavity $\mathbf{5}c_3$ to be sufficiently mixed with air. As a result, it is possible to further improve the combustion speed of the mixture in the combustion chamber of the internal combustion engine 1D, and to improve the torque while suppressing occurrence of knocking.

An internal combustion engine according to a fifth embodiment of the present invention includes a piston with a cavity and a projection in the cavity. This projection points toward the direct injection valve, in the radius direction of the piston. The rest of the components are the same as these of the fourth embodiment, and therefore, explanation thereof is omitted and the same reference signs are assigned to the same components.

Figure 13A:
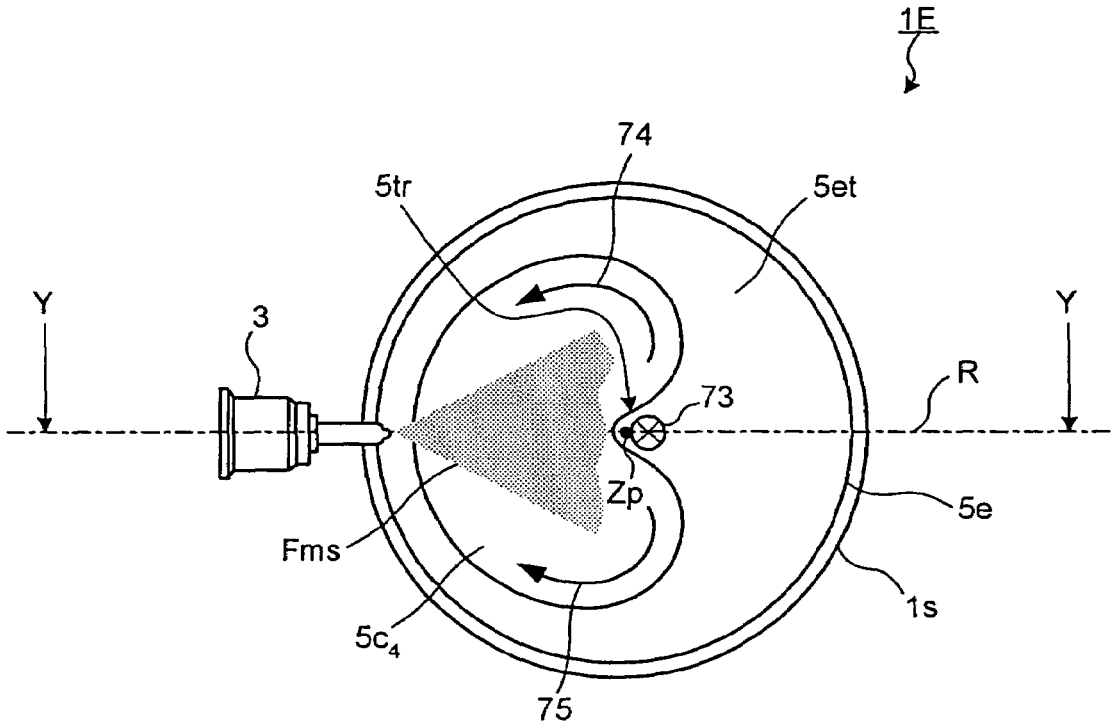
FIG. 13A is a plan view of a piston of an internal combustion engine according to a fifth embodiment.
Figure 13B:
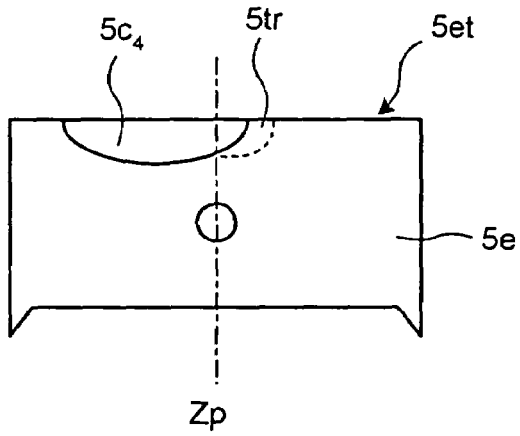
FIG. 13B is a cross section of the piston along line Y—Y shown in FIG. 13A.

FIG. 13A is a plan view of a piston 5*e* of an internal combustion engine 1E according to the fifth embodiment. FIG. 13B is a cross section taken along line Y—Y of FIG. 13A. As shown in FIG. 13A and FIG. 13B, the piston 5*e* has a cavity $\mathbf{5}c_4$, and, there is a projection 5*tr* in the cavity $\mathbf{5}c_4$. The projection 5*tr* projects toward the direct injection valve 3, in the radius direction of the piston 5*e* (the direction of central line R passing through the central axis Zp of the piston 5*e*). The fuel spray Fms injected from the direct injection valve 3 toward the cavity $\mathbf{5}c_4$ during the compression stroke collides against the projection 5*tr*.

Because of such an arrangement, as shown in FIG. 13A, the fuel spray Fms swirls in the directions of arrow 74 and arrow 75 in the cavity $\mathbf{5}c_4$ and forms two swirl flows toward combustion chamber of the internal combustion engine 1E. These swirl flows promote the turbulence of a uniform mixture that is formed with the fuel injected from the port injection valve 2 and is taken into the combustion chamber, and further promote mixing of the fuel spray Fms from the direct injection valve 3. Moreover, the fuel injected from the direct injection valve 3 collides against the projection 5*tr* provided in the cavity $\mathbf{5}c_4$ and is atomized to be sufficiently mixed with air. As a result, it is possible to further improve the combustion speed of the mixture in the combustion chamber of the internal combustion engine 1E, and to improve the torque while suppressing occurrence of knocking.

In the second to fifth embodiments, the fuel is injected from both of the port injection valve and the direct injection valve in the operating region at the low to medium speeds and the high load where the knocking easily occurs, while the fuel is injected from the direct injection valve during the compression stroke. The fuel is injected from the direct injection valve toward the cavity formed in the top part of the piston. This causes the mixture in the combustion chamber to be further agitated and disturbed, which makes it possible to further improve the combustion speed of the mixture in the combustion chamber. As a result, it is possible to further improve the torque while suppressing knocking even in the operating region where the knocking easily occurs. Furthermore, the fuel consumption rate is also reduced.

According to the present invention, it is possible to increase the torque while suppressing occurrence of the knocking.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of controlling an internal combustion engine that includes:

a port injection valve that injects fuel into an intake passage of the internal combustion engine; and a direct injection valve that injects fuel directly into a combustion chamber of the internal combustion engine, the method comprising:

determining whether operating conditions of the internal combustion engine during uniform combustion are satisfied, the operating conditions including a specified load of the internal combustion engine and a specified engine speed of the internal combustion engine, the specified load being defined as a high load based on a maximum torque of the internal combustion engine, the specified engine speed being defined as low to medium speeds based on a maximum engine speed of the internal combustion engine; and injecting fuel from both the port injection valve and the direct injection valve if it is determined at the determining that the operating conditions are satisfied, and injecting fuel at a predetermined ratio of a whole amount of fuel injection from the direct injection valve during a compression stroke.

2. The method according to claim 1, further comprising shifting a fuel injection timing of the direct injection valve to a delay angle side based on an ignition top dead center as a reference, as a fuel injection ratio of the direct injection valve decreases.

3. An apparatus for controlling operation of an internal combustion engine, the internal combustion engine including:

a port injection valve that injects fuel into an intake passage of the internal combustion engine, and a direct injection valve that injects fuel directly into a combustion chamber of the internal combustion engine, the apparatus comprising:

an operating condition determining unit that determines whether operating conditions of the internal combustion engine during uniform combustion are satisfied, the operating conditions including a specified load of the internal combustion engine and a specified engine speed of the internal combustion engine, the specified load being defined as a high load based on a maximum torque of the internal combustion engine, the specified engine speed being defined as low to medium speeds based on a maximum engine speed of the internal combustion engine;

a fuel-injection-timing deciding unit that decides a fuel injection timing of the direct injection valve, if the operating condition determining unit determines that the operating conditions are satisfied, so as to inject fuel from the direct injection valve during a compression stroke of the internal combustion engine;

a fuel-injection-ratio deciding unit that decides a fuel injection ratio between the direct injection valve and the port injection valve; and a fuel injection controller that causes both the port injection valve and the direct injection valve to inject fuel at the fuel injection ratio decided by the fuel-injection-ratio deciding unit and at the fuel injection timing of the direct injection valve decided by the fuel-injection-timing deciding unit.

4. The apparatus according to claim 3, wherein the fuel-injection-timing deciding unit shifts the fuel injection timing of the direct injection valve toward a delay angle side based on an ignition top dead center as a reference, as the fuel injection ratio of the direct injection valve decreases.

5. An internal combustion engine comprising:

a cylinder;

a piston that reciprocates in the cylinder;

a direct injection valve that injects fuel, at a predetermined ratio of a whole amount of fuel injection, directly into a combustion chamber during a compression stroke when operating conditions are satisfied, the operating conditions including a specified load of the internal combustion engine and a specified engine speed of the internal combustion engine, the specified load being defined as a high load based on a maximum torque of the internal combustion engine, the specified engine speed being defined as low to medium speeds based on a maximum engine speed of the internal combustion engine; and a port injection valve that injects fuel into an intake passage for supplying air into a combustion chamber of the cylinder under the operating conditions, the fuel being an amount corresponding to a remaining ratio, of the whole amount of fuel injection, other than a ratio at which the fuel is injected by the direct injection valve.

6. The internal combustion engine according to claim 5, wherein a fuel injection timing of the direct injection valve is shifted to a delay angle side based on an ignition top dead center as a reference, as the fuel injection ratio of the direct injection valve decreases.

7. The internal combustion engine according to claim 5, wherein the piston has a cavity, and the fuel is injected from the direct injection valve into the cavity.

8. The internal combustion engine according to claim 5, wherein the piston has a plurality of cavities, and the fuel is injected from the direct injection valve into at least one of the cavities.

9. The internal combustion engine according to claim 5, wherein the piston has a cavity, and the fuel is injected from the direct injection valve into the cavity, and the direct injection valve is positioned in such a manner that the fuel is injected in a direction that is inclined to an axis of the piston that is perpendicular to an axis of movement of the piston.

10. The internal combustion engine according to claim 5, wherein the piston has a cavity and a projection in the cavity, the projection points toward the direct injection valve and in a radius direction of the piston, and the fuel is injected from the direct injection valve on the projection.

* * * * *